US009887485B2

(12) United States Patent
Lambie et al.

(10) Patent No.: US 9,887,485 B2
(45) Date of Patent: Feb. 6, 2018

(54) RUGGEDIZED ELECTRICAL CONNECTOR

(71) Applicant: Amphenol Corporation, Wallingford, CT (US)

(72) Inventors: Kent Harold Lambie, Whitby (CA); John Mark Pahulje, Toronto (CA); Jun Cao, Shanghai (CN); Adrian Green, Newcastle (CA)

(73) Assignee: Amphenol Corporation, Wallingford, CT (US)

( * ) Notice: Subject to any disclaimer, the term of this patent is extended or adjusted under 35 U.S.C. 154(b) by 0 days.

(21) Appl. No.: 15/062,949

(22) Filed: Mar. 7, 2016

(65) Prior Publication Data

US 2017/0256881 A1 Sep. 7, 2017

(51) Int. Cl.

*H01R 13/52* (2006.01)
*H01R 13/6581* (2011.01)
*H01R 12/71* (2011.01)

(52) U.S. Cl.

CPC ..... *H01R 13/5219* (2013.01); *H01R 12/71* (2013.01); *H01R 13/5202* (2013.01); *H01R 13/6581* (2013.01)

(58) Field of Classification Search

CPC ..... H01R 12/71; H01R 13/5202; H01R 13/5219; H01R 13/6581; H01R 33/95; H01R 33/965

USPC ..... 439/271, 278, 281, 283

See application file for complete search history.

(56) References Cited

U.S. PATENT DOCUMENTS 6,139,351 A * 10/2000 Schaefer ..... B60L 3/0069 439/372
6,540,559 B1 * 4/2003 Kemmick ..... H01R 23/688 439/108
7,686,656 B2 * 3/2010 Zheng ..... H01R 23/6873 439/660
D618,623 S 6/2010 Peng
D633,049 S 2/2011 Arai et al.
D660,244 S 5/2012 Yudate
D664,925 S 8/2012 Yudate
D664,926 S 8/2012 Yudate
8,388,380 B1 * 3/2013 Van der Steen ... H01R 13/5202 439/607.36
D690,268 S 9/2013 Sasaki
D690,269 S 9/2013 Sasaki
(Continued)

*Primary Examiner* — Tulsidas C Patel
*Assistant Examiner* — Travis Chambers
(74) *Attorney, Agent, or Firm* — Blank Rome LLP; Charles R. Wolfe, Jr.; Tara L. Marcus

(57) ABSTRACT

A ruggedized electrical connector that includes a shell that has an interface front side and an opposite rear side for mounting on a printed circuit board. An interface sealing member is coupled to the interface front side of the shell. The interface sealing member substantially covers the interface front side of the shell for preventing contaminants from passing externally around the shell. A contact subassembly is received in the shell and includes a plurality of contacts and a housing supporting the contacts. Each of the contacts has an interface end and a tail end. The interface ends are arranged in a mating platform extending from the housing toward the front side of said shell for engaging a mating connector. An internal sealing member is coupled around the housing for preventing contaminants from passing internally though the shell. A rear shield is coupled to the rear side of the housing.

27 Claims, 7 Drawing Sheets

(56) References Cited

U.S. PATENT DOCUMENTS

| | | | | |
|---|---|---|---|---|
| 8,740,651 | B2 * | 6/2014 | Lee | H01R 12/58 439/108 |
| 9,312,641 | B2 * | 4/2016 | Wang | H01R 13/6585 |
| 9,429,360 | B2 * | 8/2016 | Hsiao | F26B 3/28 |
| 2013/0065442 | A1 * | 3/2013 | Nagata | H01R 13/5202 439/607.58 |
| 2015/0244099 | A1 * | 8/2015 | Lee | H01R 13/508 439/660 |

* cited by examiner

RUGGEDIZED ELECTRICAL CONNECTOR

FIELD OF THE INVENTION

The present application relates to a ruggedized electrical connector configured to mount to a printed circuit board.

BACKGROUND OF THE INVENTION

In the current electronics market, the demand for electrical connectors which are smaller, thinner, lighter, and more powerful is increasing at an exponential rate. Technology has reached a point where the existing electrical connectors, such as Universal Serial Bus (USB) connectors, are becoming a limiting factor in the design of newer platforms and devices due to their relatively large size and internal volume. Additionally, the usability and robustness requirements of the USB connectors have surpassed the capability of existing connectors.

Therefore, a need exists for an improved electrical connector, namely an improved USB connector, which addresses the evolving needs of platforms and devices and is capable of withstanding extreme environments, while maintaining all of the functional benefits of existing connectors, particularly existing USB connectors.

SUMMARY OF THE INVENTION

Accordingly, an exemplary embodiment of the present invention provides a ruggedized electrical connector that includes a shell that has an interface front side and an opposite rear side for mounting on a printed circuit board. An interface sealing member is coupled to the interface front side of the shell. The interface sealing member substantially covers the interface front side of the shell for preventing contaminants from passing externally around the shell. A contact subassembly is received in the shell and includes a plurality of contacts and a housing supporting the contacts. Each of the contacts has an interface end and a tail end. The interface ends are arranged in a mating platform extending from the housing toward the front side of said shell for engaging a mating connector. An internal sealing member is coupled around the housing for preventing contaminants from passing internally though the shell. A rear shield is coupled to the rear side of the housing.

The present invention also provides a ruggedized electrical connector mountable to a printed circuit board that has a conductive shell having an interface front side and an opposite rear side. The conductive shell provides a ground path to the printed circuit board. A contact subassembly is received in the conductive shell and includes a plurality of contacts. Each of the plurality of contacts has an interface end and a tail end. The interface ends are configured and arranged in a mating platform for engaging a mating connector. A conductive rear shield coupled to the rear side of the conductive shell. A contact footprint is provided on the printed circuit board. The contact footprint includes plated holes arranged in a pattern and each receives the tail ends of the plurality of contacts, respectively. The pattern of the plated through holes being configured to improve the electrical properties of the ruggedized electrical connector.

Other objects, advantages and salient features of the invention will become apparent from the following detailed description, which, taken in conjunction with the annexed drawings, discloses a preferred embodiment of the present invention.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE EXEMPLARY EMBODIMENTS

Figure 2:
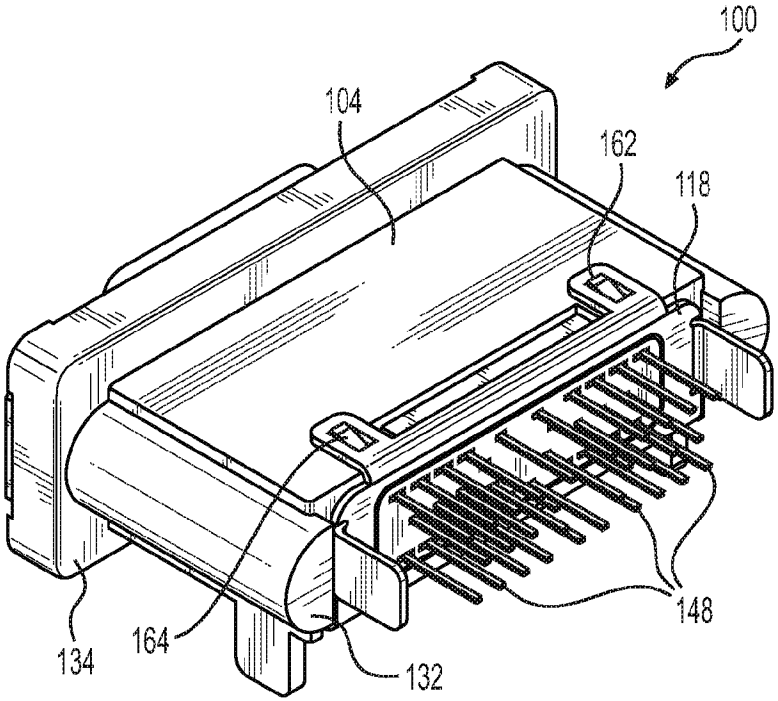
FIG. 2 is a rear perspective view of the electrical connector illustrated in FIG. 1.
Figure 1:
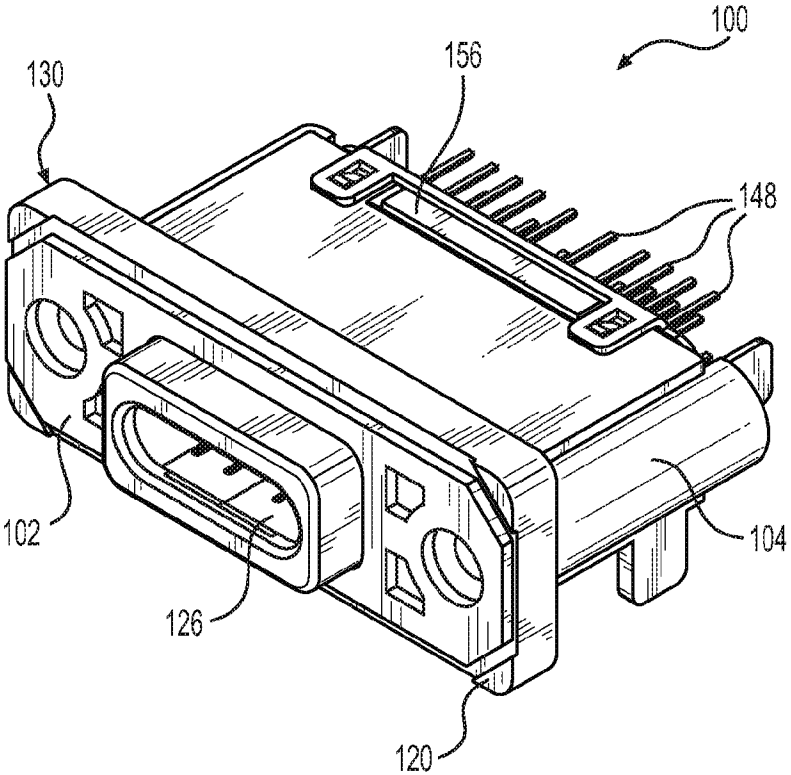
FIG. 1 is front perspective view of a ruggedized electrical connector in accordance with a first exemplary embodiment of the present invention.

Referring to FIGS. 1-9, the present invention relates to a ruggedized electrical connector 100, 200 that mounts to a printed circuit board 900. In a preferred embodiment, the electrical connector may be a USB type connector, such as a USB Type C connector, that complies with both the USB specification and IPC standards. The ruggedized electrical connector of the present invention may be either a vertical connector 100 or a right angle connector 200. The term ruggedized means the electrical connector is capable of withstanding extended use in extreme environments, such as rigorous vibration and exposure to harsh elements. Ruggedized also means the electrical connector is fully submersible and resistant to corrosion. The electrical connector 100, 200 of the present invention is designed to minimize weight, minimize size, and ensure safety. The minimization of the size and weight allows the electrical connector to be used in portable electronic devices, such as portable computers, portable GPSs, agricultural equipment, and the like, where space is limited and minimized weight is desired. The present invention also provides a unique footprint for the printed circuit board on which either version of the ruggedized electrical connector 100 or 200 may be mounted where the footprint is designed to improve impedance, insertion loss, return loss, crosstalk performance.

The ruggedized electrical connector of the present invention may be a vertical/straight version connector 100 (FIGS. 1-4) or a right angle version connector 200 (FIGS. 5-8). In the vertical embodiment 100, the contact tails extend straight out of the rear of the connector. As a result, the printed circuit board 900 is parallel to the panel that the electrical connector is mounted on. In the right-angle embodiment 200, the contact tails bend 90 degrees at the rear of the connector. As a result, the printed circuit board 900 is perpendicular to the panel that the connector is mounted on.

Referring to FIGS. 1-4, the ruggedized vertical connector 100 generally includes an interface sealing member 102, a shell 104, an inner shield 106, ground plates 108, a contact subassembly 110, an internal sealing member 112, a footprint spacer 114, a rear shim spacer 116, and a rear shield 118. The interface sealing member 102 is adapted to fit on the front face 120 of the shell 104 and acts as a barrier between the panel on which the connector is to be mounted and the shell 102. The interface sealing member 102 is preferably formed of gasket material, such as a silicone rubber that may be conductive to assist in grounding. The interface sealing member 102 prevents any contaminants from passing externally around the perimeter of the shell 104. The interface sealing member 102 includes a generally flat body 122 with a central opening 124 for accommodating an interface extension 126 of the shell 104. The body 122 of the interface sealing member 102 is shaped to be received in a recessed area 128 at the front face 120 of the shell 104. The interface sealing member 102 substantially covers the front face 120 of the shell 104.

The shell 104 houses the internal components of the electrical connector 100 and may also act as a ground path to the circuit board 900. The shell 104 is preferably formed of a conductive material, such as a die-cast zinc alloy. The shell 104 includes a front end 130 that includes the front face 120 for mounting to a panel and an opposite rear end 132 for mounting to the circuit board 900. The interface extension 126 extending from the front face 120 may be a UBS Type C receptacle interface, for example. The rear end 132 of the shell 104 is open, thereby allowing the contact tails to extend therethrough and engage the circuit board 900. The front end 130 defines a flange 134 around the body of the shell 104 and the rear shield 118 couples to the shell's rear end 132 to retain the components therein.

Figure 4:
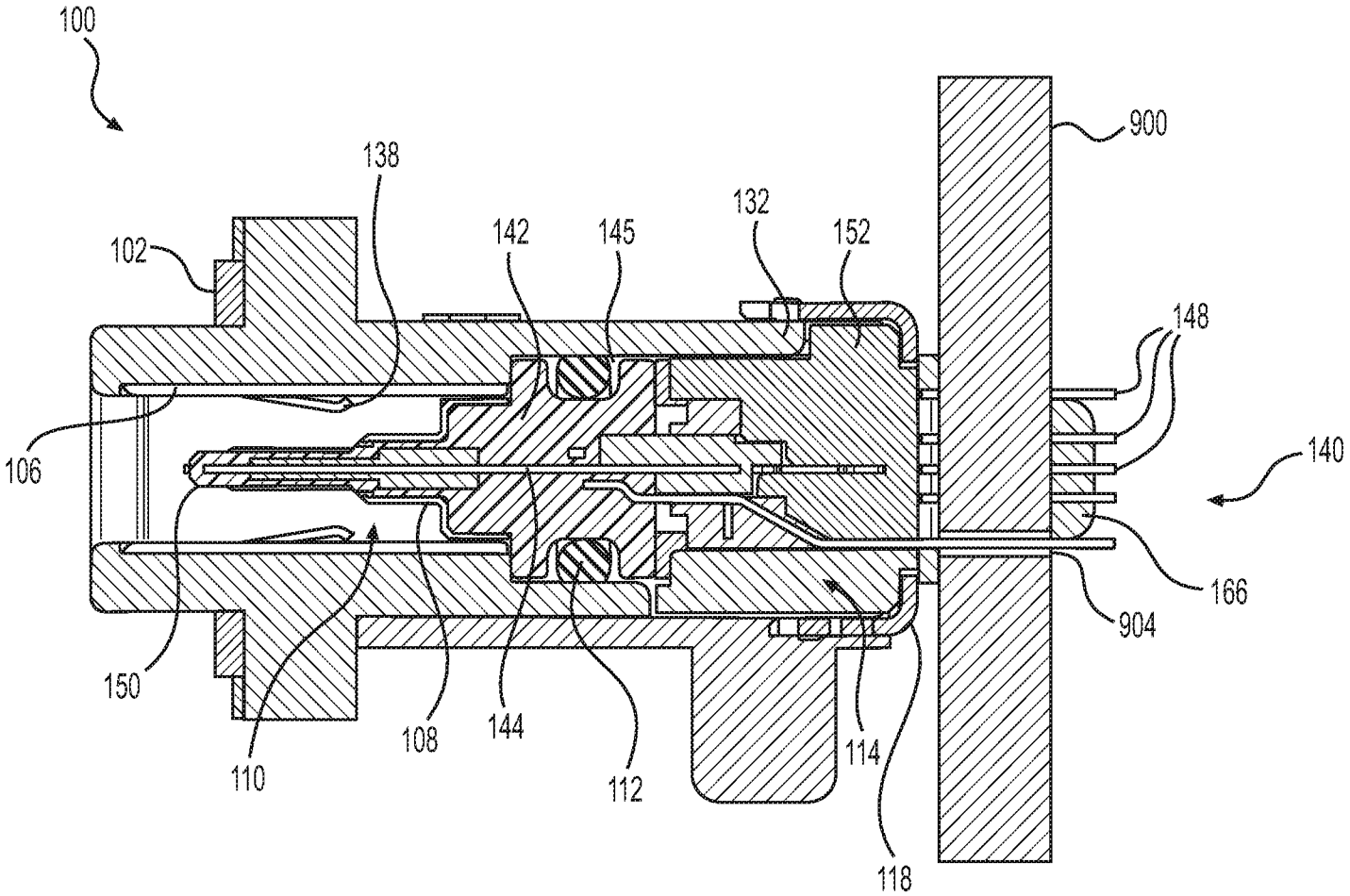
FIG. 4 is a cross-sectional view of the electrical connector illustrated in FIG. 1.
Figure 6:
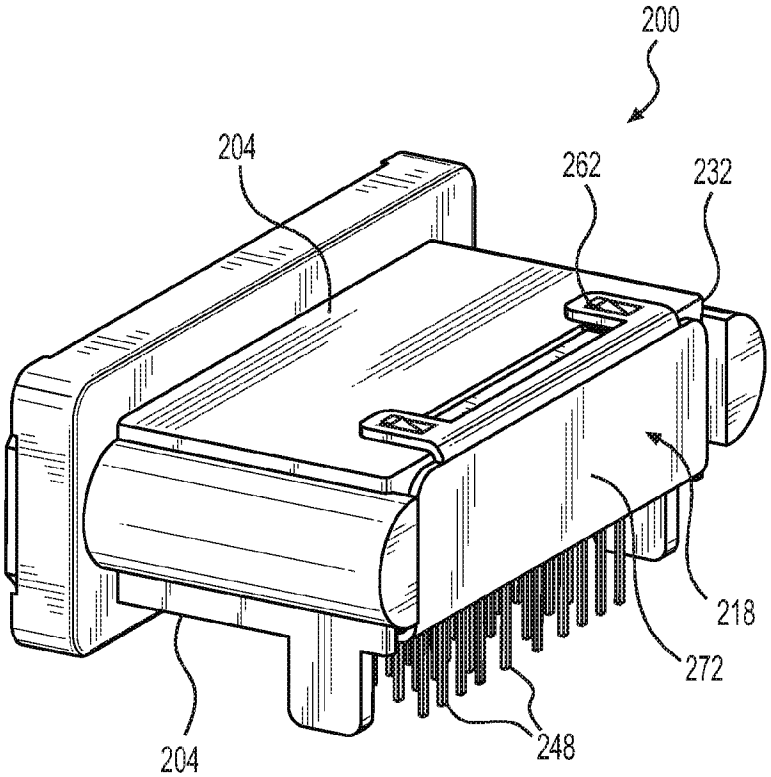
FIG. 6 is a rear perspective view of the electrical connector illustrated in FIG. 5.
Figure 5:
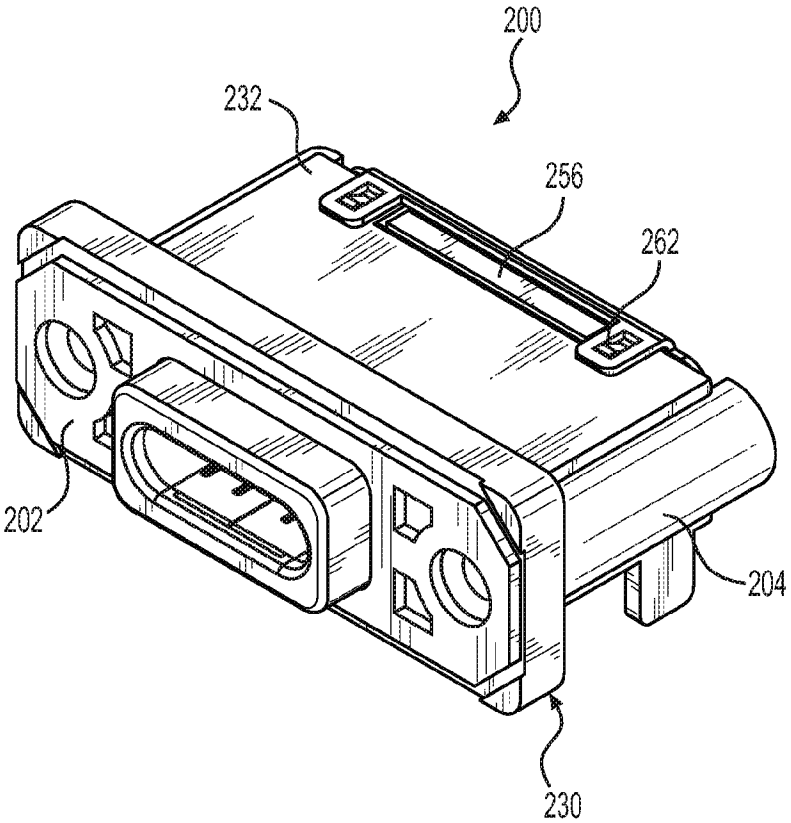
FIG. 5 is front perspective view of a ruggedized electrical connector in accordance with a second exemplary embodiment of the present invention.
Figure 7:
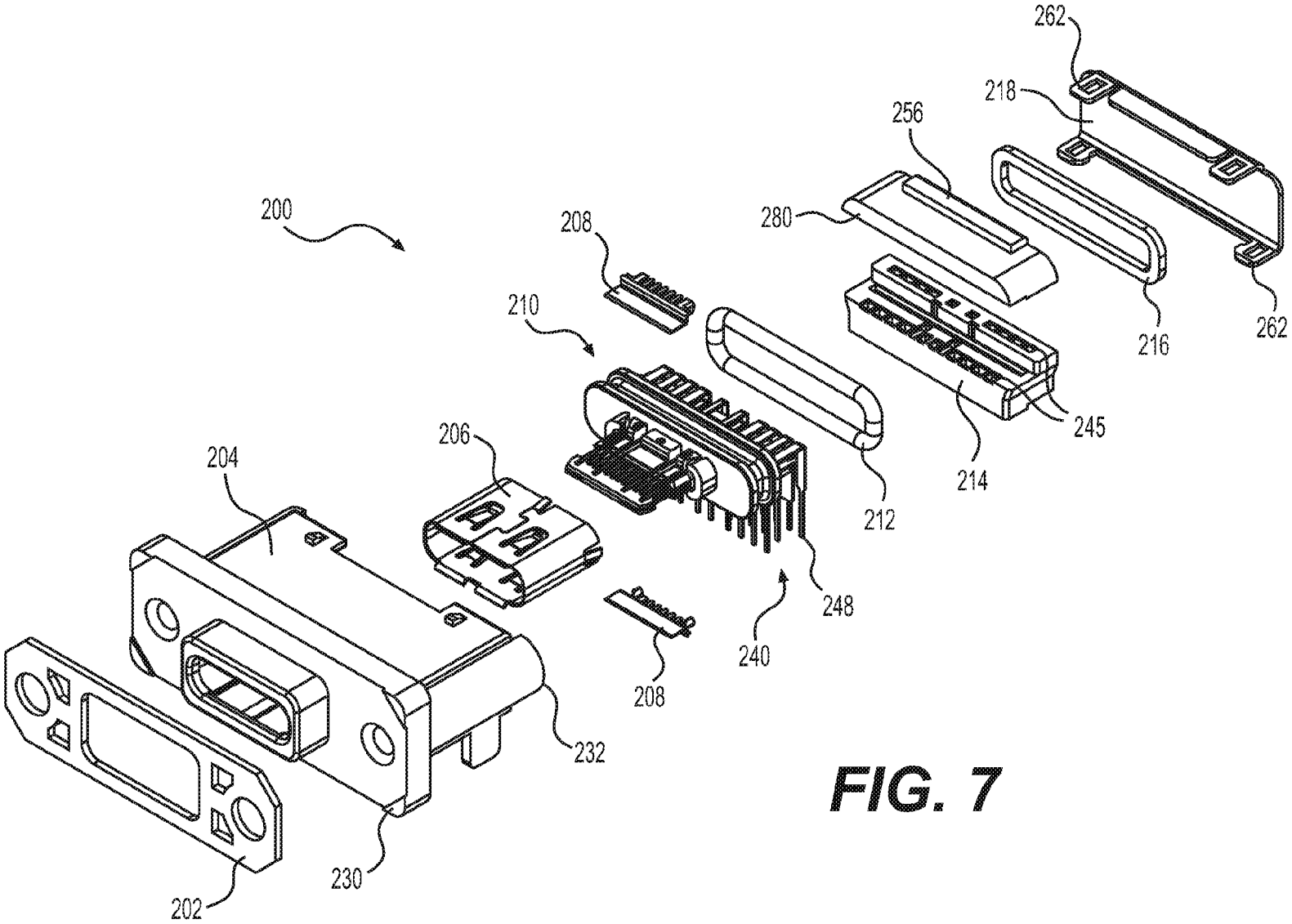
FIG. 7 is an exploded view of the electrical connector illustrated in FIG. 5.
Figure 8:
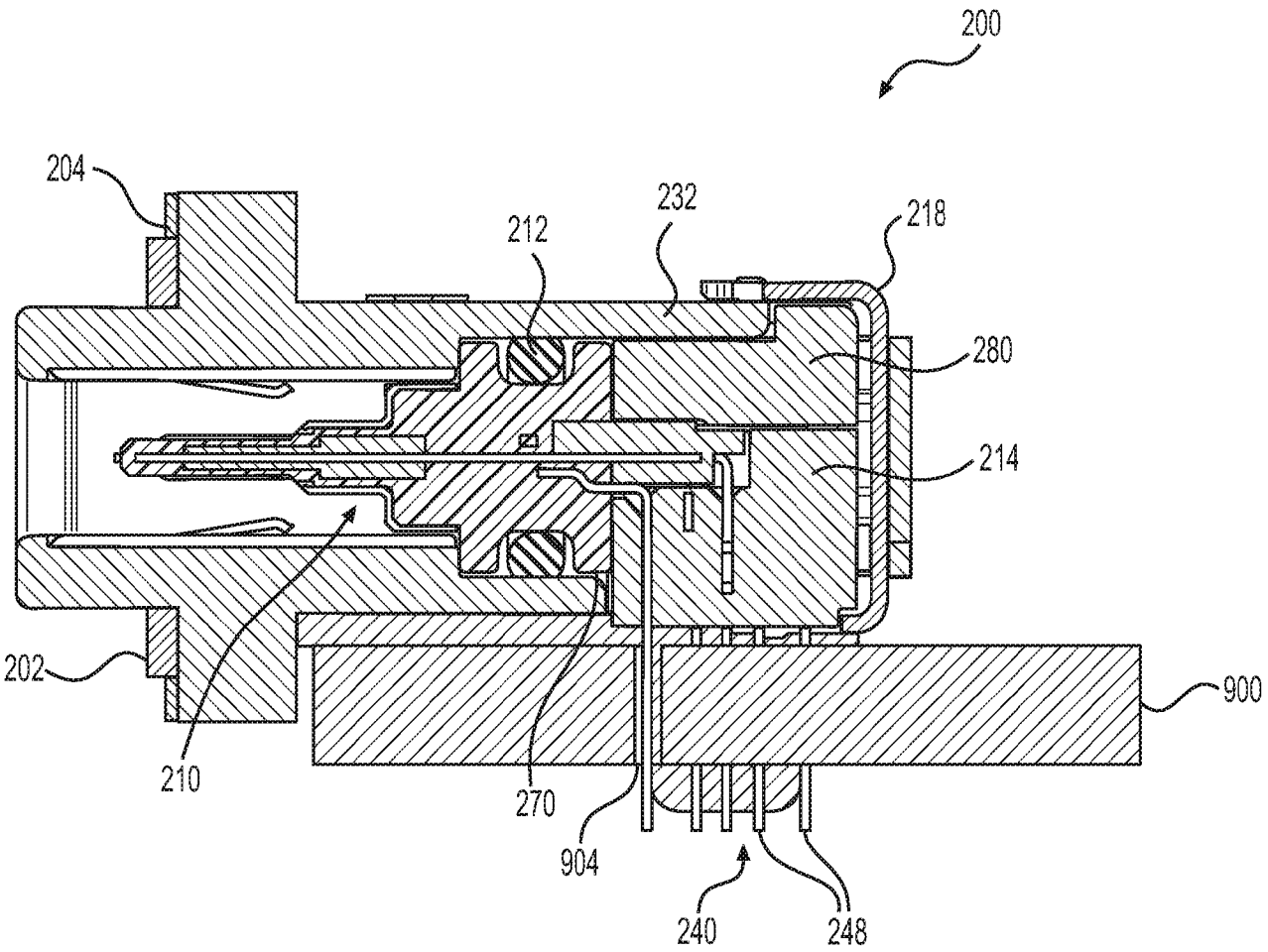
FIG. 8 is a cross-sectional view of the electrical connector illustrated in FIG. 5.

The inner shield 106 is disposed near the front end 130 of the shell and forms part of the mating interface of the electrical connector 100, as best seen in FIG. 4. The inner shield 106 also acts as a ground path by electrically connecting the ground plates 108 with the shell 104. Fingers 138 may be provided on the inner shield 106 for increased electromagnetic shielding. The ground plates 108 are coupled to the contact subassembly 110 and engage the metal shield on the mating connector (not shown), and provide a ground return path. Fingers may be provided on the ground plates 108 for improved grounding and to facilitate loading. The inner shield 106 and the ground plates 108 are preferably formed of a conductive material, such as stainless steel.

Figure 3:
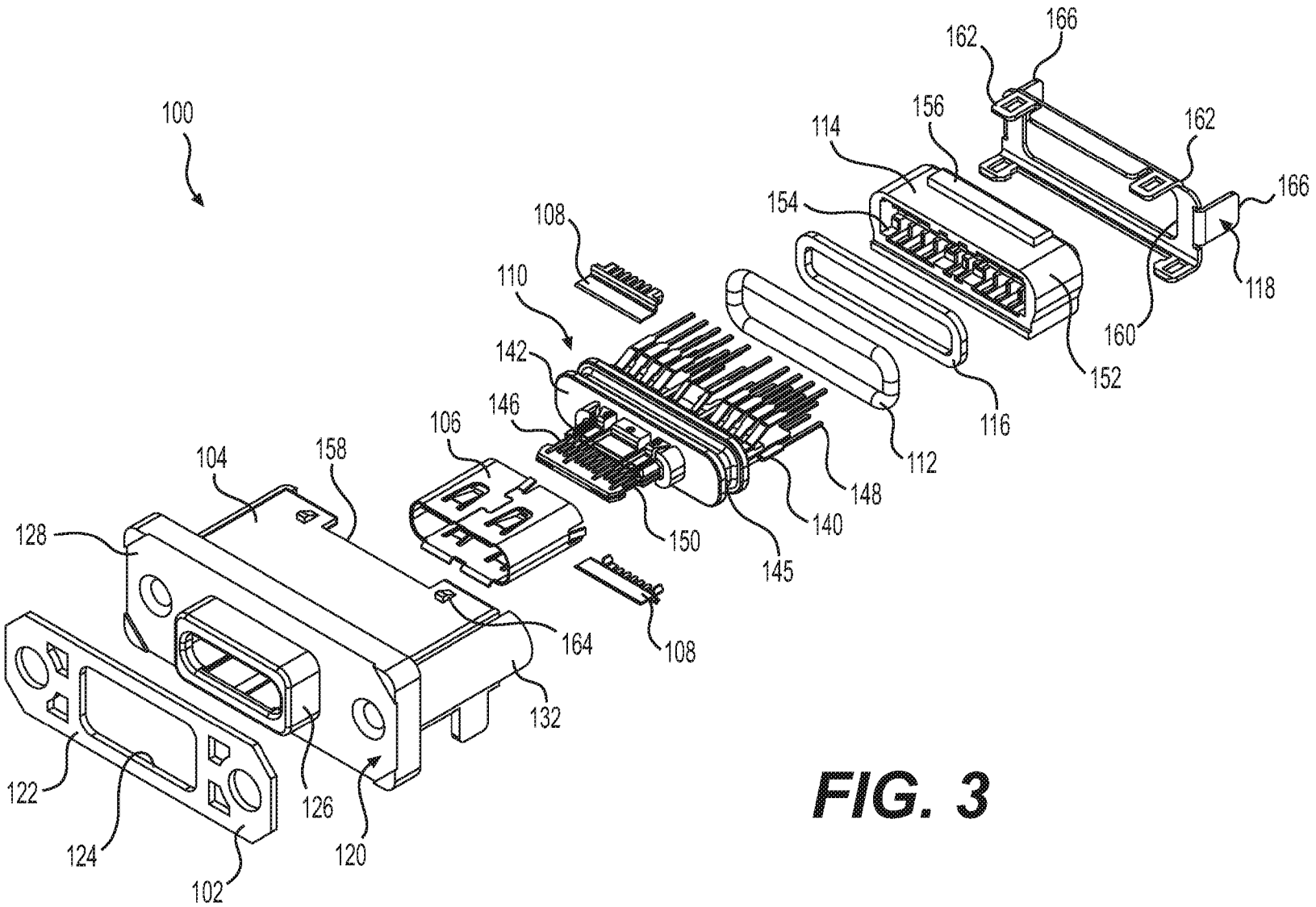
FIG. 3 is an exploded view of the electrical connector illustrated in FIG. 1.

The contact subassembly 110 generally includes a plurality of contacts 140 and a housing 142 supporting those contacts 140. The housing 142 may be an overmold surrounding the middle of the contacts 140, as seen in FIG. 3. The contacts 140 transfer signal and power from the mating connector, through the ruggedized electrical connector 100 of the present invention, to the printed circuit board 900. A mid-plate 144 is provided between the rows of contacts 140 which acts as a shield to mitigate crosstalk between the contacts 140. The mid-plate 144 is connected to the ground of the printed circuit board 900 when the connector 100 is mounted thereon. The housing 142 secures the contacts 140 and the mid-plate 144 in place, and acts as an electrical insulator between the conductive components. An outer channel 145 is provided in the housing 142 for receiving the internal sealing member 112. Each of the contacts 140 has an interface end 146 and a tail end 148. The interface ends 146 of the contacts 140 are arranged in a mating platform 150 that extends from the housing 142 toward the front face 120 of the shell 104. As seen in FIG. 4, the grounding plates 108 are attached to either side of the mating platform 150. The tail ends 148 extend from the rear end 132 of the shell 104 to engage the printed circuit board 900. The tail ends 148 of the contacts 140 are generally parallel to the longitudinal axis of the connector 100.

The internal sealing member 112 is received in the channel 145 of the contact subassembly housing 142 to prevent any contaminants from passing internally through the connector 100. In a preferred embodiment, the internal sealing member 112 is an O-ring formed of a non-conductive rubber material, such as silicone rubber. When the internal sealing member 112 is installed, it deforms to fill any gaps that are present in the electrical connector 100 to ensure an air-tight seal. In a preferred embodiment, the compression percentage of the internal sealing member 112 cross-section is about 25% and the percentage stretch on the inner diameter of the internal sealing member 112 is about 3%.

The footprint spacer 114 ensures proper spacing of the contact tails 148 and restricts excessive movement between the contacts 140 that could be damaging to the electrical connector 100. The plastic material of this footprint spacer preferably has a higher dielectric constant than the housing body 142 in order to lower the impedance of the rear termination area of the connector The body 152 of the spacer 114 is sized to fit into the rear end 132 of the shell 104 and includes a plurality of passageways 154 for receiving the individual contacts 140. A pattern created by these passageways 154 matches the footprint (FIG. 9) of the printed circuit board 900. An alignment member 156 may be provided on the body 152 of the spacer 114 that aligns and positions the spacer 114 in the shell rear end 132 and also couples with the rear shield 118. The alignment member 156, may be for example, an extended ledge that resides in a complementary cutout 158 at the rear end 132 of the shell 104.

The rear shield 118 is coupled to the rear of the shell 104 and latches thereto, thereby applying pressure throughout the connector 100 to secure all of the components in place. The rear shield 118 has a frame body that is preferably formed of a conductive material, such as stainless steel. The frame body defines as opening 160 that allows the contact tails 148 to extend therethrough. One or more latching members 162 extend from the rear shield 118 toward the shell 104 for engaging corresponding latching members 164 on the shell's rear end 132. In a preferred embodiment, the latching members 162, such as tabs, may snap onto the latching members 164, such as detents, of the shell 104. Standoffs 166 are provided that protrude from the rear shield 118 away from the shell 104 for completing the ground path between the ground plates 108, the inner shield 106, and the shell 104 via contact tails 148 that are soldered to the circuit board 900. The rear shim spacer 116 is between the spacer 114 and the rear shield 118 and deforms under the pressure applied by the rear shield 118 to fill any extra space in the rear cavity of the connector 100.

Referring to FIGS. 5-8, the right angle connector embodiment 200 is similar to the vertical embodiment 100 including that the front of both the vertical and right angle embodiments is the same. As with the vertical embodiment, the right angle embodiment 200 generally includes an interface sealing member 202, a shell 204, an inner shield 206, ground plates 208, a contact subassembly 210, an internal sealing member 212, a footprint spacer 214, a rear shim spacer 216, and a rear shield 218. The rear of the right angle embodiment 200 is different in some aspects compared with the vertical embodiment 100 to accommodate the right angle orientation of the connector 200 (and its contacts) with respect to the printed circuit board 900. More specifically, the shell 204, the footprint spacer 214, the rear shim spacer 216, the rear shield 218, and the plurality of contacts 240 of the right angle embodiment 200 are designed differently than those same components of vertical embodiment 100. Any elements of the right angle connector 200 that are not described are the same as the vertical connector embodiment 100.

The shell 204 of the right angle connector 200 is similar to the shell 104 of the vertical embodiment 100, except for a cutout 270 (FIG. 8) provided in its bottom. Like the shell 104, the shell 204 houses the internal components of the electrical connector 200 and also acts a ground path. The shell 204 includes a front end 230 for mounting to a panel and an opposite rear end 232 for mounting to the circuit board 900. The front end 230 receives an interface sealing member 202 similar to sealing member 102 of the vertical embodiment. The cutout 270 is provided in the bottom of the shell 204 at its rear end 232 to accommodate the contact tail ends 248, which extend at a generally 90 degree angle with respect to the longitudinal axis of the connector.

Because the cutout 270 is provided in the shell's bottom for the contact tails 248, the rear shield 218 does not include a cutout or opening for receiving the contact tails, unlike the rear shield 118 of the vertical embodiment. Instead, the rear shield 218 provides a plate body 272 for closing off the rear end 232 of the shell 204. Additionally, unlike the rear shield 118 of the vertical embodiment 100, the rear shield 218 does not include standoffs for engaging the printed circuit board in view of the right angle (and not vertical) orientation of the connector 200. Standoffs 274 may be provided on the shell 204 which engage the circuit board 900. Like the rear shield 118 of the vertical embodiment, the rear shield 218 includes one or more latching members 262 that engage the rear end 232 of the shell 204.

Like in the vertical embodiment, the contacts 240 of the right angle connector 200 are supported by an overmolded housing 242 that includes a channel 254 for receiving an internal sealing member 212 similar to the sealing member 112 of the vertical connector 100. Each of the contacts 240 is bent substantially 90 degrees such that the interface ends 146 thereof are generally perpendicular to the tail ends 248.

The footprint spacer 214 of the right angle embodiment is smaller than the spacer 114 of the vertical embodiment. The pattern of the passageways 245 in the spacer 214 is identical to the pattern of the passageways 154 in the spacer 114 of the vertical embodiment. And that pattern matches the footprint (FIG. 9) of the printed circuit board 900. The footprint spacer 214 is assembled onto the contacts 240 after the tails 248 are bent 90 degrees, and rests in the rear cavity of the shell 204. The spacer 214 ensures that the contacts remain bent 90 degrees in the rear cavity of the shell 204 when a force is applied to the bottom of the contact tails 248, such as during installation. A contact spacer 280 associated with the footprint spacer 214 is provided for the right angle embodiment 200 that rests on top of the footprint spacer 214. Both spacers 214 and 280 fit securely in the rear cavity of the shell 204, and do not interfere with any of the surrounding components. The contact spacer 280 includes an alignment member 256 that aligns with and engages the rear end 232 of the shell 204. The plastic material of this footprint spacer 214 and contact spacer 280 preferably has a higher dielectric constant than the housing body 210 in order to lower the impedance of the rear termination area of the connector.

Figure 9:
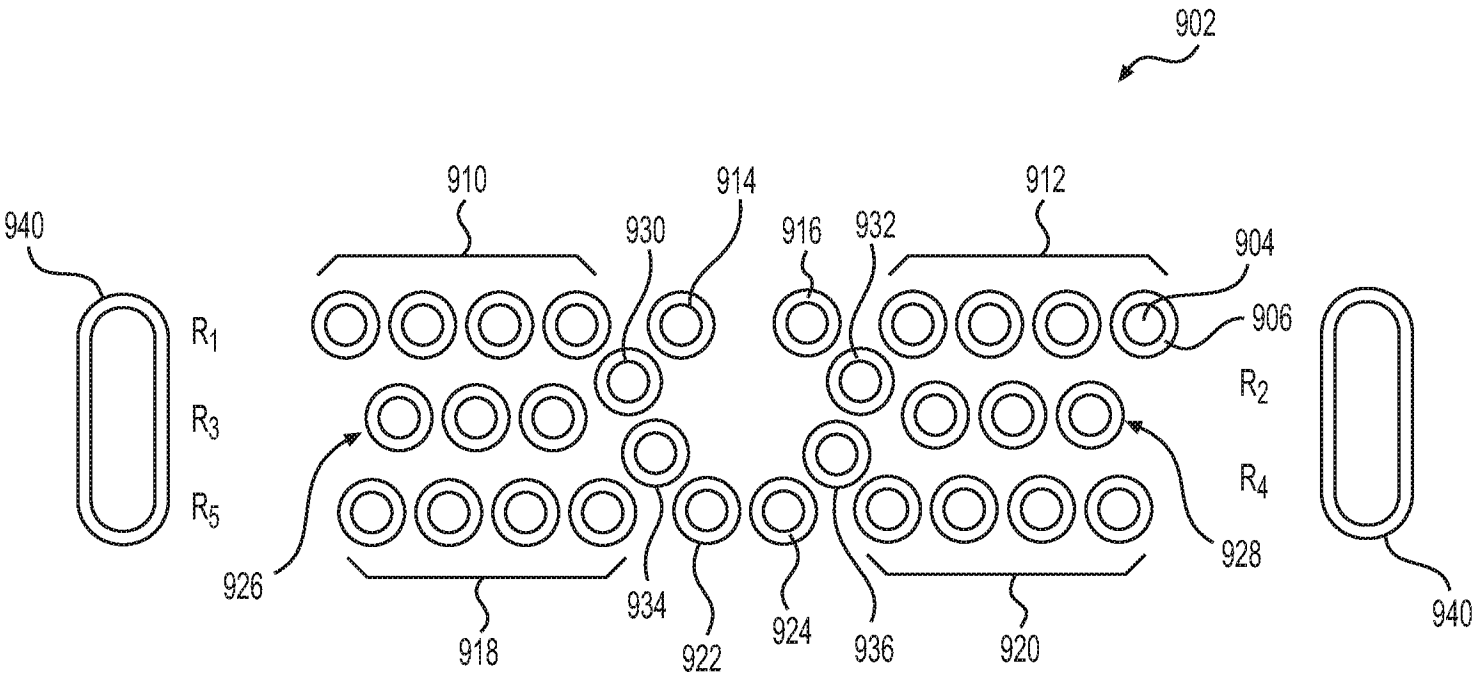
FIG. 9 is a diametrical view of a contact footprint of a print circuit board on which the electrical connectors of the first and second embodiments may be mounted.

The present invention contemplates that the printed circuit board 900 and its footprint 902 are designed to improve the electrical properties of the ruggedized connector, such as improved impedance, insertion loss, return loss, and cross-talk performance. As seen in FIG. 9, the footprint 902 of the circuit board 900 includes a pattern of holes 902 that engage the individual contact tails 148 and 248 of either connector 100 or 200.

In a preferred embodiment, each hole 904 is plated on its inner wall to assist with solder wicking with the contact tails 148 and 248. Solder wicking is a process by which capillary action pulls the solder into the holes 904. The plating makes an electrical connection with traces that run throughout the circuit board 900. An annular conductive ring or pad 906 surrounds each hole 904. The diameters of the holes 904 are sized to ensure sufficient wicking in the plated through holes 904 during installation of the connectors 100 and 200.

As mentioned above, the interface of the ruggedized electrical connectors 100 and 200, and thus the number and arrangement of the contacts 140 and 240, is preferably a USB Type-C connector. The footprint 902 of the printed circuit board 900 is designed for mating with the contacts 140 and 240, respectively. To reduce break out on the pads 906, the pitch between the holes 904 is increased, as compared to, for example, the spacing of the reference footprints for a hybrid design (i.e. a combination of SMT and through hole terminations) in the Type C specification. The minimum spacing between the annular rings 906 is preferably a minimum of 0.1 mm, the diameter of the holes 904 is preferably greater than 0.47 mm in order to allow enough space for the contacts and provide space for solder to wick up into the via, and the diameter of the pads 906 preferably ranges between 0.87 mm to 0.97 mm.

As seen in FIG. 9, the plated holes 904 are arranged in five rows, $R_1$, $R_2$, $R_3$, $R_4$, and $R_5$. Rows $R_1$ and $R_5$ form the outer rows of the footprint 902 and are adapted to mate with the signal contacts of the ruggedized connector of the present invention. Row $R_3$ forms a middle row spaced equally between rows $R_1$ and $R_5$. Row $R_3$ is adapted to mate with the ground contacts of the ruggedized connector. $R_1$ includes ten plated holes 904 which are arranged in first and second groups 910 and 912 of four holes with two spaced holes 914 and 916 located between the first and second groups 910 and 912. Row $R_5$ similarly includes first and second groups 918 and 920 of four holes with two adjacent holes 922 and 924 located between the first and second groups 918 and 920. Row $R_3$ includes first and second groups 926 and 928 of three holes. The first group 926 of row $R_3$ is arranged between the first groups 910 and 918 of the outer rows $R_1$ and $R_5$. The second group 928 of row $R_3$ is arranged between the second groups 912 and 920 of the rows $R_1$ and $R_2$. Row $R_2$ includes two holes 930 and 932 where one hole 930 is adjacent both the first group of holes 910 of row $R_1$ and the first group of holes 926 of row $R_3$ and the other hole 932 is adjacent the second group of holes 912 of row $R_1$ and the second group of holes 928 of $R_3$. Row $R_4$ includes two holes 934 and 936 where one hole 934 is adjacent to the first group of holes 918 of row $R_5$ and the other hole 936 is adjacent to the second group of holes 920 of row $R_5$. On either ends of the rows are slots 940 for receiving the standoffs of the connector shell.

While particular embodiments have been chosen to illustrate the invention, it will be understood by those skilled in the art that various changes and modifications can be made therein without departing from the scope of the invention as defined in the appended claims.

What is claimed is:

1. A ruggedized electrical connector, comprising:

a shell having an interface front side and an opposite rear side for mounting on a printed circuit board;

an interface sealing member coupled to said interface front side of said shell, said interface sealing member substantially covering said interface front side of said shell for preventing contaminants from passing externally around said shell;

a contact subassembly received in said shell including a plurality of contacts and a housing supporting said contacts, each of said plurality of contacts having an interface end and a tail end, said interface ends being configured and arranged in a mating platform extending from said housing toward said interface front side of said shell for engaging a mating connector;

an internal sealing member coupled around said housing for preventing contaminants from passing internally though said shell;

a conductive rear shield behind said housing of said contact subassembly and coupled to said rear side of said housing; and a deformable rear shim spacer being provided between said rear shield and said housing of said contact subassembly.

2. A ruggedized electrical connector according to claim 1, wherein said tail ends of said plurality of contacts extend in an axis substantially parallel to a longitudinal axis of said shell; and said rear shield is open, thereby allowing the tail ends of said plurality of contacts to extend therethrough.

3. A ruggedized electrical connector according to claim 1, wherein said tail ends of said plurality of contacts extending in an axis substantially perpendicular to a longitudinal axis of said shell; and said rear shield is closed.

4. A ruggedized electrical connector according to claim 1, wherein said interface front side of said shell includes a recess sized to receive said interface sealing member.

5. A ruggedized electrical connector according to claim 4, wherein said interface sealing member includes a central opening for receiving an interface extension extending from the interface front side of said shell.

6. A ruggedized electrical connector according to claim 4, wherein said interface sealing member is formed of a conductive rubber.

7. A ruggedized electrical connector according to claim 1, wherein said housing of said contact subassembly is an overmold surrounding said plurality of contacts.

8. A ruggedized electrical connector according to claim 1, wherein said housing includes an outer channel that tightly receives said internal sealing member.

9. A ruggedized electrical connector according to claim 8, wherein said internal sealing member is formed of a non-conductive rubber.

10. A ruggedized electrical connector according to claim 9, wherein a compression percentage of a cross-section of said internal sealing is about 25%; and a percentage stretch on an inner diameter of the internal sealing member is about 3%.

11. A ruggedized electrical connector according to claim 1, further comprising a footprint spacer disposed between said rear side of said shell and said rear shield, said footprint spacer having a pattern of passageways for receiving said tail ends of said plurality of contacts.

12. A ruggedized electrical connector according to claim 11, further comprising a contact spacer coupled to said footprint spacer for securing said tail ends in said footprint spacer.

13. A ruggedized electrical connector mountable to a printed circuit board, comprising:

a conductive shell having an interface front side and an opposite rear side, said conductive shell providing a ground path to said printed circuit board;

a contact subassembly received in said conductive shell including a plurality of contacts, each of said plurality of contacts having an interface end and a tail end, said interface ends being configured and arranged in a mating platform for engaging a mating connector;

a conductive rear shield coupled to said rear side of said conductive shell; and a contact footprint provided on said printed circuit board, said contact footprint including plated holes arranged in a pattern for improving the electrical properties of the ruggedized electrical connector and each plated hole receiving said tail ends of said plurality of contacts, respectively, said pattern of said plated through holes consisting of five rows of said plated holes, said rows include a middle row that is equally spaced from first and second outer rows, said plated holes of first and second outer rows being configured to mate with signal contacts of said plurality of contacts, and said plated holes of said middle row being adapted to mate with ground contacts of said plurality of contacts.

14. A ruggedized electrical connector according to claim 13, further comprising a footprint spacer disposed between said rear side of said conductive shell and said conductive rear shield, said footprint spacer having a pattern of passageways for receiving said tail ends, said pattern of passageways of said footprint spacer matching said pattern of plated holes in said printed circuit board.

15. A ruggedized electrical connector according to claim 13, wherein each of said plated holes includes an annular conductive pad.

16. A ruggedized electrical connector according to claim 13, wherein said tail ends of said plurality of contacts extend in an axis substantially parallel to a longitudinal axis of said shell; and said rear shield is open, thereby allowing said tail ends of said plurality of contacts to extend therethrough.

17. A ruggedized electrical connector according to claim 13, wherein said tail ends of said plurality of contacts extend in an axis substantially perpendicular to a longitudinal axis of said shell; and said rear shield is closed.

18. A ruggedized electrical connector according to claim 13, wherein each of said first and second rows includes ten plated holes which are arranged in first and second groups of four holes with two spaced holes located between said first and second groups.

19. A ruggedized electrical connector according to claim 18, wherein said middle row includes first and second groups of three holes where said first group of said middle row is arranged between said first groups of said first and second outer rows and second group of said middle row is arranged between the second groups of said first and second outer rows.

20. A ruggedized electrical connector according to claim 19, wherein a fourth row of said five rows of plated holes includes two holes where one hole is adjacent both the first group of holes 910 of said first outer row and said first group of holes of said middle row and the other hole of said fourth row is adjacent said second group of holes of said first outer row and the second group of holes of said middle row.

21. A ruggedized electrical connector according to claim 20, wherein a fifth row of said five rows of plated holes includes two holes where one hole is adjacent to said first group of holes of said second outer row and the other hole is adjacent to said second group of holes of said second outer row.

22. A ruggedized electrical connector according to claim 21, wherein said contact footprint includes a slot at either end of said five rows for receiving a standoff extending from either said conductive shell or said conductive rear shield, said interface front side of said shell includes a recess sized to receive said interface sealing member.

23. A ruggedized electrical connector according to claim 13, further comprising an interface sealing member that includes a central opening for receiving an interface extension extending from the interface front side of said shell.

24. A ruggedized electrical connector according to claim 23, wherein said interface sealing member is formed of conductive rubber.

25. A ruggedized electrical connector according to claim 13, wherein said contact subassembly includes a housing with an outer channel that tightly receives an internal sealing member.

26. A ruggedized electrical connector according to claim 25, wherein said internal sealing member is formed of a non-conductive rubber.

27. A ruggedized electrical connector according to claim 26, wherein a compression percentage of a cross-section of said internal sealing is about 25%; and a percentage stretch on an inner diameter of the internal sealing member is about 3%.

* * * * *